United States Patent [19]

Mott

[11] Patent Number: 4,793,958

[45] Date of Patent: Dec. 27, 1988

[54] METHOD OF MOLDING A RACQUET WITH STRING SECURING LOOPS

[76] Inventor: Jonathan C. Mott, Olde Forge Cottage, The Common, Wonersh - Nr. Guildford, GU50PJ, England

[21] Appl. No.: 942,038

[22] Filed: Dec. 15, 1986

Related U.S. Application Data

[63] Continuation of Ser. No. 662,100, Oct. 18, 1984, abandoned.

[30] Foreign Application Priority Data

Oct. 18, 1983 [GB] United Kingdom ..... 8327851

[51] Int. Cl.[4] ..... B29C 45/14

[52] U.S. Cl. ..... 264/274; 249/91; 249/94; 264/278; 273/73 D; 425/116

[58] Field of Search ..... 264/278, 273, 274; 273/73 A, 73 D, ; 425/116, 123, 814; 249/91, 94

[56] References Cited

U.S. PATENT DOCUMENTS

| | | | |
|---|---|---|---|
| 222,229 | 12/1879 | Benls et al. | 249/94 |
| 1,636,687 | 7/1927 | Robinson . | |
| 2,454,193 | 11/1948 | Martin | 249/94 |
| 2,579,072 | 12/1951 | Harris | 264/274 |
| 2,604,661 | 7/1952 | Karns | 425/116 |
| 2,850,767 | 9/1958 | Ford | 249/94 |
| 3,086,777 | 4/1963 | Lacoste . | |
| 3,108,328 | 10/1963 | Kelleher | 425/123 |
| 3,363,038 | 1/1968 | Billarant | 264/278 |
| 3,420,929 | 1/1969 | Morin | 264/278 |
| 3,476,851 | 11/1969 | Camossi | 264/278 |
| 3,815,660 | 6/1974 | Gallagher et al. | 273/73 D |
| 3,874,667 | 4/1975 | Gallagher et al. . | |
| 3,947,029 | 3/1976 | Gallagher | 273/73 D |
| 4,046,377 | 9/1977 | Khazzam . | |
| 4,119,313 | 10/1978 | Popplewell et al. . | |

FOREIGN PATENT DOCUMENTS

| | | | |
|---|---|---|---|
| 2033630 | 4/1970 | France . | |
| 2263795 | 10/1975 | France | 273/73 D |
| 2056864 | 3/1981 | United Kingdom . | |
| 1603834 | 12/1981 | United Kingdom | 273/73 D |

OTHER PUBLICATIONS

"Melt-Away Insert Trims Part Weight", *Plastics World,* May, 1983.

*Primary Examiner*—James Lowe

*Attorney, Agent, or Firm*—Banner, Birch, McKie & Beckett

[57] ABSTRACT

A moulded plastic racquet has string-securing loops which are moulded into the frame during racquet fabrication. The loops preferably are held in cooperating locating members which fit within the frame mould. A racquet throat member having string-securing loops is formed in a similar manner. The string-securing loops may be preformed by crimping a length of wire into sinous shape. The invention also includes a mould for making such a racquet or racquet throat.

5 Claims, 2 Drawing Sheets

FIG. 1
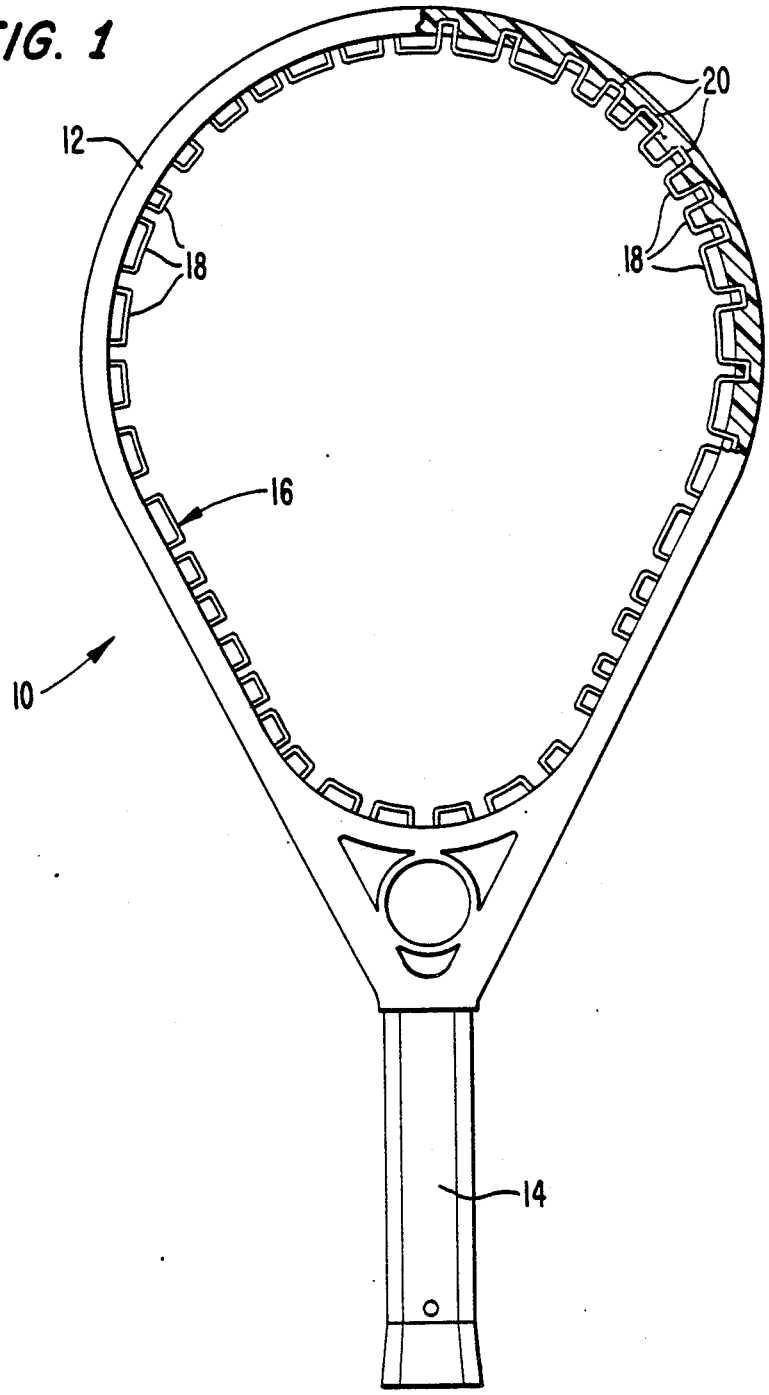
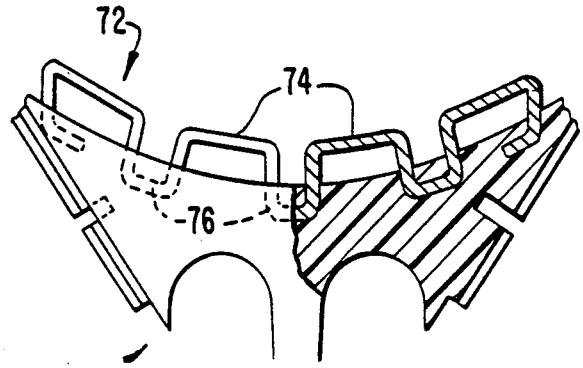
FIG. 3

METHOD OF MOLDING A RACQUET WITH STRING SECURING LOOPS

This application is a continuation of application Ser. No. 662,100, filed Oct. 18, 1984, and now abandoned.

BACKGROUND

This invention relates to racquets.

A typical racquet comprises an approximately oval frame, usually of wood or extruded aluminum, having a plurality of holes extending substantially radially therethrough, the stringing of the racquet being directly secured to the frame by passing individual strings thereof through the holes. Typically, a given string is passed outwardly through a respective hole in the frame and then inwardly through an adjacent hole.

However, such a racquet suffers from a number of disadvantages. For example, parts of the stringing are at least partly exposed at the radially outer surface of the frame (i.e., between adjacent holes in the frame), and are thus subject to damage as a result of impacts, e.g., with the ground. Also the strings tend to fret against the frame, especially where they pass over the edges of the radially outer ends of the holes in the frame, this fretting eventually leading to breakage of the strings. Additionally, manufacturing costs are increased by the necessity for drilling and deburring the holes, and providing the fitting grommets in the holes, all of which operations can be labour intensive. Most significantly, the holes in the frame tend to set up stress concentrations, so that when the frame is severely stressed, it almost invariably breaks in the region of a hole.

It has already been proposed in my United Kingdom Patent Publication Nos. 2,094,643 and 2,136,300 to alleviate the above-mentioned disadvantages by providing a racquet in which the frame has a groove extending around the greater part of its internal periphery. The stringing of this racquet is secured to the frame by means of a one-piece sinuous string-securing member made from a suitably bent length of wire, which is held in the groove in various ways.

These proposals, although they do indeed alleviate the aforementioned disadvantages and provide excellent racquets, are aimed primarily at the more expensive, high quality, end of the racquet market. There remains a need for a racquet which is less expensive to manufacture, but which nevertheless retains at least some of the advantages of the racquets of my prior proposals.

SUMMARY OF THE INVENTION

According to one aspect of the present invention, there is provided a racquet comprising a frame and stringing, wherein the frame is moulded in a plastic material, and the stringing is secured to the frame by means of string-securing loops which are moulded into the frame during the moulding thereof.

According to another aspect of the invention, there is provided a throat member for a racquet, the throat member being moulded in a plastics material and having string-securing loops moulded thereinto during the moulding thereof.

According to a further aspect of the invention, there is provided a method of making a racquet, the method including the steps of forming a plurality of string-securing members each comprising a generally U-shaped loop having the upper ends of the limbs of its U-shape bent over, supporting the string-securing members in a mould shaped to define the frame of the racquet, such that said upper ends of said limbs are disposed inside the mould cavity while the loops project out of the mould cavity into the area which will be surrounded by the moulded frame, and injecting a plastics material into the mould to mould the frame around said upper end of said limbs, whereby after moulding, the loops each project radially inwardly of the moulded frame to receive and position at least one string of the stringing of the racquet.

According to a yet further aspect of the invention, there is provided a method of making a throat for a racquet, the method including the steps of forming a plurality of string-securing members each comprising a generally U-shaped loop having the upper ends of the limbs of its U-shaped bent over, supporting the string-secured members in a mould shaped to define said throat, such that said upper ends of said limbs are disposed inside the mould cavity while the loops project out of the mould cavity from the region thereof which defines the portion of the throat which is intended to form part of the internal periphery of the frame of the racquet, and injecting a plastics material into the mould to mould the throat around said upper ends of said limbs.

In all four aspects of the invention, the string-securing members are preferably made from metal, e.g., wire.

In preferred implenentations of all four aspects of the invention, a plurality of said string-securing loops are integrally formed by suitably bending a single length of wire.

The invention also comprises a mould for use in either of the methods described above, the mould comprising:

first and second cooperating locating members having substantially flat mating surfaces shaped to receive and entrap therebetween the loops of the string-securing members, such that the bent-over upper ends of the limbs of the string-securing members, and the immediately adjacent portions of the limbs, project from the periphery of the locating members substantially in the plane of their mating surfaces; and first and second cooperating mould members having substantially flat mating surfaces which intersect the mould cavity, the mould members being shaped to closely surround the locating members with the mating surfaces of the mould members substantially parallel to or coplanar with the mating surfaces of the locating members;

the mating surfaces of the mould members being shaped to locate therebetween the portions of the limbs of the string-securing members immediately adjacent the bent-over upper ends, such that the bent-over ends are disposed in the mould cavity.

BRIEF DESCRIPTION OF THE DRAWINGS

The invention will now be described, by way of example only, with reference to the accompanying drawings, of which:

FIG. 1 is a plan view, partly in section, of a moulded racquet-ball racquet in accordance with the present invention;

FIG. 3 is a plan view showing part of a racquet throat member in accordance with the present invention.

DESCRIPTION OF THE PREFERRED EMBODIMENTS

Figure 2:
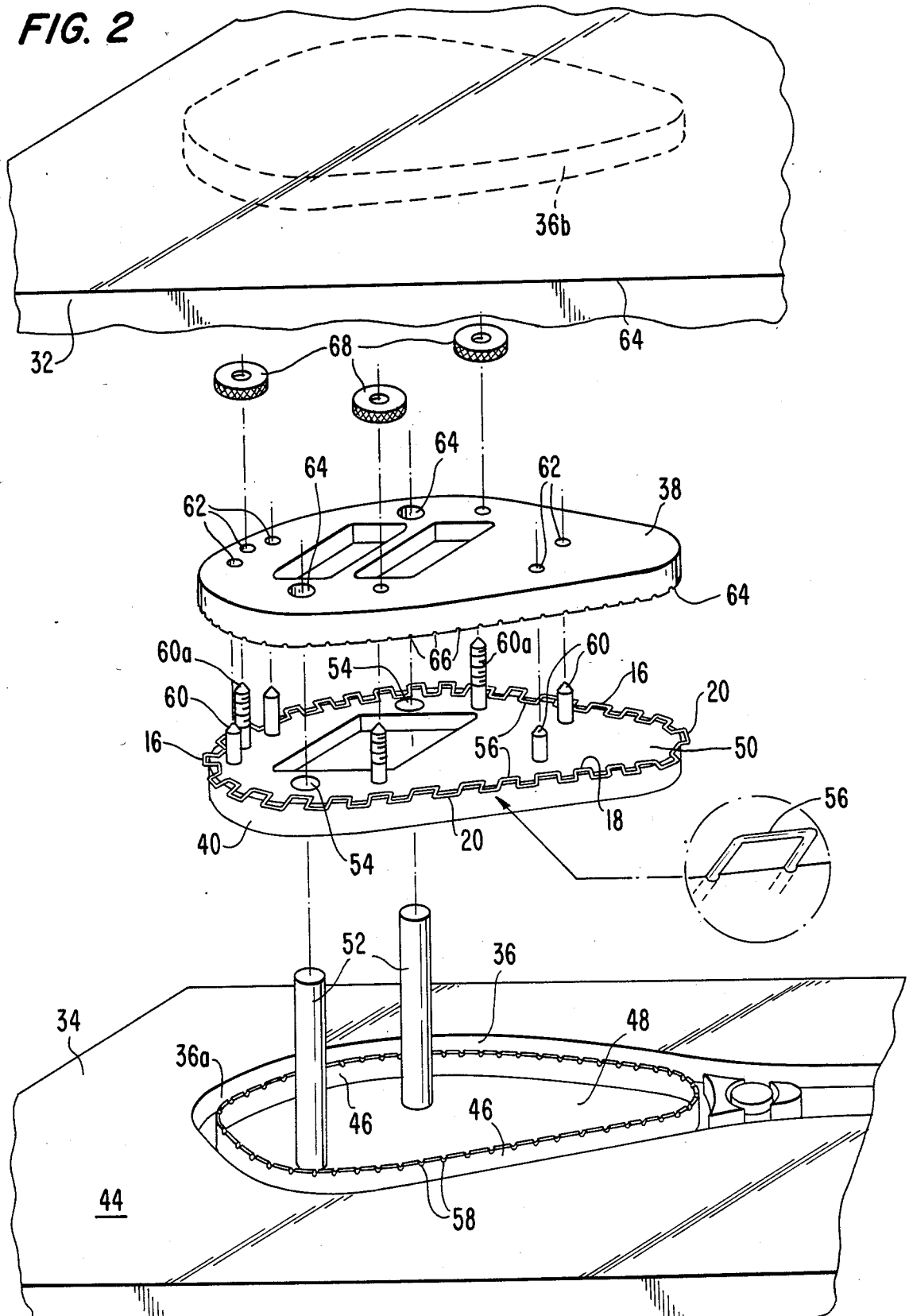
FIG. 2 shows a mould for making the racquet of FIG. 1, using a method in accordance with the present invention.

The racquet-ball racquet shown in FIG. 1 is indicated generally at 10, and comprises a symmetrical, approximately pear-shaped frame 12 having a handle 14 projecting from the narrower end of its pear-shape in alignment with the major axis of the pear shape. The frame 12 and handle 14 are integrally moulded in a plastics material, such as nylon, preferably reinforced with 10% to 30% of carbon fibre, or of glass fibre, or of a mixture of both.

The frame 12 is provided with a one-piece with string-securing member 16, which is moulded into the frame during the moulding process by which the frame is produced. As can be seen in FIG. 1, the string-securing member 16 comprises a single length of 2 mm steel of titanium wire bent into a sinuous shape resembling castellations or crenellations in plan view, and defining a plurality of U-shaped loop portions 18, of which adjacent ones are joined together at the tops of the limbs of their U-shapes by connecting portions 20.

The string securing member 16 is moulded into the frame 12 such that the tops of the limbs of the U-shapes of the loop portions 18, and the connecting portions 20 joining them, are embedded in, and therefore firmly and irremovably secured in, the plastics material of the frame, with the remainder of each loop portion 18 projecting radially into the frame, to receive and position at least one string of the stringing (not shown).

FIG. 2 shows the components of the mould used to make the racquet 10, this mould being designated generally by reference 30. As can be seen from FIG. 2, the mould 30 comprises four principal components, specifically upper and lower complementary mould plates 32 and 34 respectively, which together define the basic mould cavity 36 in which the racquet 10 is moulded, and upper and lower locating members 38, 40 respectively, which together define a "cassette" for precisely locating and supporting the wire string-securing member 16 with respect to the mould cavity 36: for clarity, only the lower mould plate 34 is shown in detail in FIG. 2.

The lower mould plate 34 comprises a flat rectangular plate of steel, having a flat upper surface 44 in which is formed the lower half 36*a* of the cavity 36, i.e., the half defining the lower half of the finished racquet 10 when the racquet is lying on a flat, horizontal surface. Thus the plane of the surface 44 coincides with the plane which the stringing of the finished racquet 10 will occupy. The half-cavity 36*a* has a radially inner wall 46 which is of the order of 1 mm thick, and which surrounds a recess 48 shaped to receive the lower locating member 40.

The lower locating member 40 has a flat upper surface 50 which is precisely flush with the upper surface 44 and the top of the wall 46 of the lower mould plate 34 when the member 40 is mounted in the recess 48. Furthermore, the locating member 40 is precisely located within the recess 48 by two upwardly extending, circular-section, locating pins 52, which project from the base of the recess into corresponding locating holes 54 passing through the locating member.

The flat upper surface 50 of the member 40 is provided with a plurality of U-shaped grooves 56 of semi-circular cross-section, each of which extends into the surface 50 from one edge of the member 40, and then back out again. The spacing and shape of the grooves 56 is such that each one receives and locates a respective loop portion 18 of the wire string-securing member. The tops of the limbs of the U-shapes of the loop portions 18 thus project radially outwardly of the member 40, and pass through respective semi-circular cut-outs 58 formed for that purpose in the top of the wall 46 of the lower mould plate 34. As a result, the connecting portions 20 joining the loop positions 18 of the string-securing member 16 are positioned near the centre-line of the half-cavity 36*a*.

The upper surface 50 of the lower locating member 40 is provided with a plurality of upwardly extending studs 60 provided in the coplementarily-shaped upper locating member 38. Further holes 64 are provided in the member 38 to accommodate the locating pins 52 of the lower mould plate 32.

The upper locating member 38 has a flat lower surface 64, in which are formed U-shaped grooves 66. The grooves 66 are precisely aligned with and complementary to the grooves 56 in the lower locating member 40, so that when the members 38, 40 are correctly located with respect to each other by way of the studs 60 and holes 62, and fastened together with their respective surfaces 50, 64 in contact with each other, the string-securing member 16 is firmly entrapped between them. To permit the members 38, 40 to be fastened together, several of the studs 60 are elongated so that they project through the member 38, and threaded as shown at 60*a*: the fastening is then completed by knurled nuts 68.

In use, the two locating members 38 and 40 are secured together with the string-securing member 16 entrapped therebetween, as described above. The cassette defined by the fastened-together locating members 38, 40 is then located in the recess 48 in the lower mould plate 34 by means of the locating pins 52, such that the connecting portions 20 of the string-securing member 16 are disposed in the half-cavity 36*a*. The mould cavity 36 is then closed by means of the upper mould 32, which is basically complementary to the lower mould plate 34. In particular, the upper mould plate 32 has a flat lower surface (not shown) which mates with the upper surface 44 of the mould plate 34, this flat lower surface containing a half-cavity 36*b* which is complementary to the half-cavity 36*a* in the mould plate 34, so as to define therewith the cavity 36. Additionally the half-cavity 36*b* has a radially inner wall (not shown) which is complementary to and mates with the inner wall 36 of the half-cavity 36*a*. Finally, the upper mould plate 32 is provided with holes (not shown) which cooperate with the locating pins 52, to precisely locate the mould plate 32 with respect to the mould plate 34.

Once the mould plates 32 are secured together as described above, the aforementioned plastics material, loaded with the selected proportion(s) of the selecting reinforcing fibre(s), is injected under pressure into the mould cavity 36 in the usual manner, until the cavity is full. To facilitate this, the cavity 36 typically has two suitably positioned feed-in points, or spures, e.g., one on each side of the portion which defines the lower part (as viewed in FIG. 1) of the internal periphery of the frame 12, and several suitably positioned vents, e.g., three on each side of the portion which defines the handle 14 and at least one in the portion which defines the upper part (as viewed in FIG. 1) of the frame 12.

When the plastics material has set, the mould plates 32, 34 and the locating members 38, 40 are separated, exposing the moulded racquet 10 with the wire string-supporting member 16 firmly and irremovably embedded in the frame 12. All that remains to complete the racquet 10 is to remove any flash, to wrap and bond a leather or other material suitable for gripping around the handle 14, and to string the racquet with nylon, gut or the like.

It will be appreciated that the racquet 10 has very few components and is therefore relatively simple and inexpensive to make. However, its strength: weight ratio is much improved, so that for a given weight, it is stronger, and so less subject to twist, and therefore plays more accurately.

Although the invention has been described with reference to its application to an entire racquet, it also has application to just part of a racquet, specifically a racquet throat member. This application is illustrated in FIG. 3, which shows at 70 a moulded plastics throat member in accordance with the present invention. The throat member 70 is shaped to slot into the V-shaped shape defined between the two handle-defining portions of an extruded aluminum frame of a racquet of the general type shown in my earlier UK Patent Specification No. 1,603,834, in substantially the position shown for the throat member 24 of my earlier application. As can be seen in FIG. 3, the throat member 70 is provided with a single wire string-supporting member 72, bent to define four string-receiving loops 74 joined together by connecting portions 76. The member 72 is moulded into the member 70, typically in a mould process substantially similar to that described with reference to FIGS. 1 and 2, such that the connecting portions 76 are irremovably embedded in the member 70.

Several modifications can be made to the described preferred embodiments of the invention. In particular, the one-piece wire string-supporting members 16 and 72 can each be replaced if desired by a plurality of individually U-shaped wire string-supporting loops, each having the upper ends of the limbs of their U-shapes bent over or flattened to ensure they are irremovably keyed into the plastics material of the frame 12 in which they are embedded. Also, the cassette defined by the locating members 38,40 can be modified so that one of the members, e.g. the member 38, is fully grooved or recessed to the full depth of the diameter of the string-securing member 16, so that the member 16 is wholly received in said one member 38. This makes it easier to insert the member 16 on the member 38. In this case, the lower surface 64 of the upper locating member 38 can be completely flat, with the result that the mating surfaces 50,64 of the locating members 38,40 are no longer flush with the upper surface 44 of the lower mould plate 34, but displaced parallel to and 1 mm above the surface 44.

Additionally, two or more of the throat members 70 can be moulded in a single mould, with all of the respective string-supporting member 72 supported in a single cassette. Alternatively, the cassette can be omitted, and each member 72 can be located in grooves formed in the upper surfaces of suitably positioned pillars similar to the pins 52, but having the aforementioned upper surfaces flush with the surface 44.

Although the string-securing member 16 is described as being metal, it can be made of other material: in particular, it can be made of a permanently or temporarily stiffened or otherwise suitably supported plastics or synthetic fibre material whose tensilte strength is at least comparable with that of the stringing, e.g. KEVLAR and/or carbon fibre.

Although the invention has been described with reference to a racquet-ball racquet, it can also be used in tennis racquets, squash rackets, badminton racquets and the like. Further modifications will be apparent to those skilled in the art without departing from the scope of the invention as defined by the appended claims.

I claim:

1. A method of making a racquet, the method comprising the steps of:

forming a plurality of string-securing members in the form of a sinuous shape with oppositely facing U-shaped loops defined by limbs connected by bent over inner and outer ends with form string-securing loops and string-securing loop anchorages, respectively;

providing a mould shaped to define the frame of the racquet with said mould forming a mould cavity including a radially inner wall with cuts-outs for receiving limbs of the U-shaped loops;

providing first and second separable and cooperating locating members separate from said mould, with said locating member each having a peripheral wall shaped and dimensioned to fit closely adjacent to the radially inner wall of said mould;

securing the plurality of string-securing members in said locating members by sandwiching the inner ends and adjacent portions of the limbs between said first and second locating members and by having the remaining portions of the limbs and the outer ends extend past said peripheral walls of said locating members;

supporting the remaining portions of the limbs and the outer ends of the loops of the string-securing members in said mould cavity by placing said peripheral wall of said locating members adjacent said radially inner wall of said mould so that said locating members are disposed outside of said mould cavity and the remaining portions of the limbs together with the outer ends of the U-shaped loops extend through said cut-outs in said radially inner wall of said mould to be located within said mould cavity; and injecting a plastics material into said mould cavity to mould the frame around the remaining portions of the limbs and the outer ends of the loops located within said mould cavity, whereby after moulding the inner ends of the loops project radially inwardly of the moulded frame to receive and position at least one string of the stringing of the racquet.

2. A method as claimed in claim 1, wherein the string-securing members are made from metal.

3. A method as claimed in claim 2, wherein the string-securing members are made from wire.

4. A method of making a racquet according to claim 1 wherein said first and second cooperating locating members have substantially flat mating surfaces shaped to receive and entrap therebetween the inner ends and adjacent portions of the limbs of the string-securing members.

5. A method of making a racquet according to claim 4 wherein said mating surface of one of said locating members is shaped to wholly receive the loops of the string-securing members, and said mating surface of said other locating member is substantially wholly flat where it contacts the inner ends and adjacent portions of the limbs of the string-securing members.

* * * * *